US008087391B2

(12) United States Patent
Tores et al.

(10) Patent No.: US 8,087,391 B2
(45) Date of Patent: Jan. 3, 2012

(54) APPARATUS AND METHODOLOGY FOR ROCKER ARM ASSEMBLY

(76) Inventors: Lawrence S. Tores, Carson City, NV (US); Bradley A. Rounds, Reni, NV (US)

( * ) Notice: Subject to any disclaimer, the term of this patent is extended or adjusted under 35 U.S.C. 154(b) by 1173 days.

(21) Appl. No.: 10/879,547

(22) Filed: Jun. 28, 2004

(65) Prior Publication Data

US 2005/0022768 A1 Feb. 3, 2005

Related U.S. Application Data

(60) Provisional application No. 60/483,261, filed on Jun. 26, 2003.

(51) Int. Cl.
*F01L 1/18* (2006.01)

(52) U.S. Cl. ..... 123/90.41; 123/90.39; 29/888.2; 74/559

(58) Field of Classification Search ..... 123/90.39, 123/90.41, 90.44, 193.3, 193.5, 90.16, 90.2; 74/559, 560, 596, 569, 567
See application file for complete search history.

(56) References Cited

U.S. PATENT DOCUMENTS 4,505,236 A * 3/1985 Nakamura ..... 123/90.27
4,655,177 A * 4/1987 Wells et al. ..... 123/90.36
5,005,544 A * 4/1991 Spangler ..... 123/195 R
5,095,861 A * 3/1992 Dove, Jr. ..... 123/90.39
5,483,929 A * 1/1996 Kuhn et al. ..... 123/90.1
5,596,958 A * 1/1997 Miller ..... 123/90.23
5,617,818 A * 4/1997 Luders ..... 123/90.27
5,636,600 A * 6/1997 Sweetland et al. ..... 123/90.4
5,706,770 A * 1/1998 Schmidt et al. ..... 123/90.39
5,970,932 A * 10/1999 Richardson et al. ..... 123/90.36
6,230,676 B1 * 5/2001 Pryba et al. ..... 123/90.39
6,273,043 B1 8/2001 Barton
6,484,683 B2 * 11/2002 Zielke ..... 123/193.5

* cited by examiner

*Primary Examiner* — Ching Chang
(74) *Attorney, Agent, or Firm* — Ian F. Burns & Associates, P.C.

(57) ABSTRACT

One possible embodiment of the invention is essentially an apparatus and methodology for mounting a rocker arm assembly to a cylinder head of an internal combustion engine comprising of at least a unitary stanchion to which multiple rocker arms may be moveably connected. In least one embodiment, the unitary stanchion may comprise a base from which project multiple rows of pedestals. Two of more of these rows may be set in essentially parallel orientation, which further defines a primary space in which a portion of the rocker arm is located. The unitary stanchion may be secured to the cylinder head thorough multiple rows of fasteners. The footprint of the base of unitary stanchion could allow the unitary stanchion to possibly act as generally efficient external buttress for generally providing greater support across the top of the cylinder head.

27 Claims, 5 Drawing Sheets

APPARATUS AND METHODOLOGY FOR ROCKER ARM ASSEMBLY

CROSS REFERENCE TO RELATED APPLICATIONS

This patent application claims priority of and incorporates by reference the U.S. Provisional Patent Application Ser. No. 60/483,261, filed on Jun. 26, 2003.

FIELD OF THE INVENTION

The present invention relates to rocker arm assemblies. Specifically to those rocker shaft assemblies for use with internal combustion engines.

BACKGROUND

Since 1885, generally heralded as its date of birth, the internal combustion engine ("ICE"), the brainchild of Gottlieb Daimler, has become one of the most predominate means for propulsion and power generation through the world. Both in the sparked based combustion (e.g., gasoline powered) and compression based combustion (e.g., diesel powered) formats, the ICE has been used for propulsion and power for a variety of devices, including, but not limited to automobiles, planes, trains, submersibles, power generators, pumps and the like.

Since that inception, there has been a drive by designers of various embodiments of the ICE to generally increase its output and performance without necessarily making the engine larger. Indeed, these attempts to accomplish this objective many times generally coincides with attempts make the ICE smaller and lighter. The attempts generally include redesigning the engine components out of stronger and lighter materials or to generally adopt methods and apparatuses that push the various engines components to high performance/stress levels which may sometimes lead to breakage of those components. Various examples of these attempts may be highlighted in the field of automotive high performance/racing engines.

These developments are linked to the operation mechanicals of the various ICEs that are being sought to be improved. One area of ICE development could be the valve portion of the ICE and to the various mechanisms of the ICE which are used to control and operate those valves. Most ICEs have valves, with some exceptions being the small two-stroke ICEs used in toys and models and the Wankle rotary ICE. The ICE uses valves to regulate and otherwise control the intake of air fuel mixture into and the venting of exhaust from the inside of the combustion chamber(s) of the engine where the burning of the fuel/air mixture provides the power that operates the ICE. Generally, the combustion chamber describes that space where a piston moves within a generally enclosed portion of a cylinder.

Typically, in a valve-operated ICE, an atomized mixture of gasoline and air is generally introduced via the valves into a cylinder movably containing a piston. The piston inside this cylinder moves up and down (reciprocates) inside the bore of the cylinder and in conjunction with the timed opening and closing of the valves, draws the fuel/air mixture into the combustion chamber; compresses the air/fuel mix into the combustion chamber (for greater burning efficiency and resulting power); combusts (burns) the compressed air/fuel mixture into the combustion chamber; vents from the combustion chamber, the exhaust formed from the combusted air/fuel mixture.

A crankshaft movably connected to the pistons (rotors), converts the reciprocal movement of the pistons into the rotation power that is generally the power output provided by the ICE. The crankshaft also moveably connected (e.g., by gears, chains, and the like) to and synchronizes the rotation of a camshaft which is generally used to synchronize the opening and closing of valves relative to the position of a piston within a bore of a cylinder. The cam shaft has a plurality of cam lobes this action exposes a greater and lesser portion of the lobe to directly or indirectly open a valve. Generally, each cam lobe provides the movement for a respective valve. The shape or contour of the cam lobe and the rotational position of the lobe on camshaft generally determines the valve's operational characteristics (e.g., timing of valve operation: when the respective valve will open and closed, for how long will respective valve remain open/closed; operation characteristics of respective valve: how wide will the respective valve open). The design of the camshaft is generally very carefully engineered to ensure proper operation of the engine and has direct effect on engine performance.

Generally, there are a two basic means for connecting the camshaft(s) to the valves of an ICE, a direct connection and an indirect connection using a rocker arm assembly, which is also generally known as a valve train assembly. One type of direct connection is generally known as the flathead ICE where the valves are generally mounted in the engine block along the camshaft(s) to allow the camshaft(s) to generally directly operate the valves. Another type of direct connection is generally found in a multiple overhead cam ICE, where multiple camshafts and their corresponding sets of valves are mounted in the cylinder head, allowing the camshafts to generally directly operate their corresponding sets of the valves.

In some other types of ICE, a rocker arm assembly, or valve train assembly, acts as an intermediary between the camshaft(s) and their respective valves to allow the cam lobe movement of the camshaft to be transmitted to the respective valves thus orchestrating the movements of the respective valves. The rocker arm assembly is generally comprised in at least one embodiment of a rocker arm assembly, which is generally in movable contact with the valves, and can be in some embodiments a generally direct contact with cam lobes of a camshaft and in other embodiment is a generally indirect contact with the cam lobes of a camshaft.

The rocker arm assembly, or valve train assembly, which is generally seen as plurality of rocker arms movably connected in seesaw fashion to rocker arm holders (e.g., pedestals) generally affixed to the top of the ICE (e.g., at the top of a cylinder head).

In one type of rocker arm assembly-based ICE, a single overhead cam ICE, a single camshaft and corresponding valves are mounted on the top of a cylinder head along with a rocker arm assembly(s). As the camshaft generally indirectly turned by the crankshaft, the camshaft rotates at least one camshaft lob, which generally directly operates one end of a rocker arm to activate in see-saw fashion the other end of the rocker arm, which is generally moveably connected to a valve. In this manner, the camshaft can control the operation of its respective valves.

Another type a rocker arm assembly based ICE has the rocker arm assembly in generally in direct contact with a camshaft(s). In this type of ICE, also know as a pushrod ICE, a plurality of pushrods are used to movably connect a camshaft(s) to a rocker arm assembly. Here, generally, a camshaft(s) is located in the engine block with the corresponding valves being located in the cylinder head. A set of rods called pushrods, which are generally moveably located by a side of the ICE, moveably connects the cam lobes of a camshaft(s) to a rocker arm assembly(s) which is located on the top of the cylinder head(s).

In operation of a pushrod ICE, lifters (mechanical, hydraulic or otherwise), also known as tappets in certain applications, have a cylindrical or bucket shape with a top and bottom portions. The bottom portion rides on the top portion of the cam lobe. The bottom of the pushrod sits on or in the top portion of the lifter. As the cam lobe is generally rotated, it imparts an undulating motion to the lifter and hence to the push rod connected to the lifter.

The pushrod transmits this undulating motion to first end of a rocker arm, which is essentially in movable contact with the top of the push rod. As the first end of the rocker arm is generally pushed away by the pushrod, the second end of the rocker arm, which is generally in movable contact with one end of a valve, pushes onto the valve. This pushing action causes the head of the valve to project into the combustion chamber unsealing the valve opening for introduction of the air-fuel mixture into/venting of exhaust from the combustion chamber. (Generally speaking, a valve is designated to be either an exhaust or an air-fuel mixture valve).

As the camshaft lobe rotates away from the lifter/pushrod, this action releases pressure on first end of the rocker which lifts the second end of the rocker arm. This relieves the rocker arm's opening pressure on the valve. A spring(s) movable connected to the valve, then seats the valve back into the valve opening, reversibly sealing the valve opening shut. The spring, through the valve, also pushes up on the second end of the rocker arm.

Another area of development that can be seen generally as being related to the rocker arm assembly devolvement is the various type of shapes used for the combustion chamber. By altering the top of the combustion chamber, where generally the air-fuel mixture is compressed and combined with a spark source for the combustion, the combustion or burning of the air-fuel mixture may be improved releasing greater power and possibly reducing resulting pollutants. This alteration may be generally accomplishing by changing the size, shape of that portion of the cylinder head which forms the top of the combustion chamber.

One well-established combustion chamber shape is generally that of the essentially flat or wedged shaped topped combustion chamber. Here, the top is generally perpendicular to the sides of the combustion chamber. The bodies of the valves are generally located to be parallel to the orientation of the cylinder and piston.

A newer combustion chamber shape is generally one where the top of the combustion chamber has a half-dome or hemispherical shape. This hemispherical designation lends its name to those ICE using such as shaped-combustion chamber, HEMI-ICE. The hemispherical topped combustion chamber generally locates its valves at 45 degree angles to the cylinder/piston.

This design is generally favorable with the high performance ICE and their applications for several reasons; perceived increased burning efficiency in combustion (e.g., how well/quickly the spark(s)/resulting flame moves through the air-fuel mixture; perceived increased efficiency in moving in air-fuel mixture/venting exhaust (through the use of larger valves); perceived retention of heat for greater combustion; perceived greater pressures for improved combustion; and the like.

One of the limitations imposed by the HEMI design is that generally due to the half-dome shape, the valves are placed on angles. This means the mechanism(s) which operates the valves must essentially take into account and be able to mechanically work with these different angles. On a practical aspect, this limitation could hold down the number of valves to two valves per cylinder (whereas an ICE with a flat top combustion chamber and all its valves in the parallel orientation piston/cylinder could possibly have up to at least four valves).

A potential significant limitation in the HEMI-ICE operation is generally that the different valve angles may impose a complicated geometric application of a pushrod based gavel train assembly (which most HEMI-ICE's seem to use). For instance, as generally shown in FIG. 4, due to different valve location and angles at least one set of valves 16 (air-fuel mixture) may be located at ninety-degree angle compared the placement of their respective push rods 20*a*. This could lead to an inefficient or impaired movement of a pushrod 20*a* and a corresponding rocker arm 22*a* to operate the valve 16 at high speed/high performance. Such deficient valve train geometry could also impose serious limitations (via the maximum lifting that a cam shaft could provide) as to the duration of valve opening and to how open the valve could be during operation.

Some attempts to rectify this limitation have included using camshafts that have aggressive profiles (shapes) to provide cam lobes with higher and longer lifting surfaces/profiles to cause the corresponding valves to open wider for longer periods of time. When such aggressive camshafts are combined with the operational limitations imposed by the 45 degree angle placement of the valves, tremendous stress and strain on the at high speed operation result potentially leading to warping or breaking of the pushrods, rocker arms, pedestals holding the rocker arms. This warping/breakage could potentially lead to the corresponding rocker arm leading to potentially structural failure of the HEMI-ICE (e.g., the warping/breaking could cause a valve to open at the wrong time and be hit by the top of the piston with great force-resulting in possible chain reaction destruction to the piston, valve, pushrod rocker arm rocker arm pedestal, cylinder head and the like).

The cross orientation of valve and pushrod also effects the contact points between the original rocker arms and the pushrods. Both ends of the original rocker arm are in constant interference and experience exceptional frictional losses and wear.

Lack of adjustment in the original rocker arm configuration for HEMI-ICEs may also cause a great deal of problems when design changes are made to increase the valve lift and duration. When a such a compromise is instituted in the prior art for the adjusting the relationship between the "nose" of the rocker arm and the stem valve "tip," the pushrod angle relative to the rocker arm tip may become so acute that the pushrod may come in contact with the cylinder block or may attempt to climb out of its drive "seat" in the rocker arm. The opposite action may also be true. If the pushrod angle is less severe, the rocker arm-to-valve relationship may become far from usable. This conundrum has forced racers and manufacturers to make concessions in camshaft timing, valve lift and duration, and other factors thus limiting potential of obtaining greater performance from the HEMI-ICE.

Another potential limitation is the design of a push rod-operated opposing-valve ICE where the rocker arms are placed into two groups (one group controlling the exhaust valves, another group controlling the air/fuel intake valves) with each group being movable mounted on a common shaft, both shafts mounted onto individual common pedestals that are bolted onto the top of the cylinder head. Originally, this was generally a cost-saving manufacturing measure which has turned into performance limitation issue.

As shown essentially in FIGS. 2, 4, several of these original pedestals 26 may be bolted to the top of a cylinder head 11. The original series of pedestals 26 may hold the two shafts 24 in parallel spacing, but the exhaust rocker arm shaft is held above the air/fuel mixture rocker arm shaft. The rocker arms 22*a*, 23*a* are generally gang mounted on the shafts between the pedestal mounts. Spacing springs 38 may be used to hold the rocker arms 22*a*, 23*a* in the correct spacing on the shafts 24. This prior art configuration may allow for some play for the rockers arms 22*a*, 23*a* on the shafts 24 resulting in operational irregularities. This configuration can lead to flexing and subsequent damaging of the shafts 24 and pedestals 26 as the rocker arms 22*a*, 23*a*, during high performance operation, may bend and twist under severe loading and pressure.

Another potential negative factor of this type of grouped rocker arm 22*a*, 23*a*, shaft 24 and pedestal 26 design is that to replace a single valve spring 18, common equipment in racing engines, the entire prior art rocker arm, shaft and pedestals assembly generally must be removed. The same is essentially true in the case of a damaged rocker arm 22*a*, 23*a*. Removing this entire rocker arm assembly constantly is not only monotonous but time consuming, and time is often a precious commodity in racing where runs are spaced very close together. If there is not enough time to replace damaged rocker arms or springs between runs or rounds, a race may be forfeited. If the damaged pieces are not replaced or fixed, the next run or round may be lost due to less than optimum power or worse, lead to catastrophic engine failure.

The HEMI ICE's awkward arrangement of valves and a pushrod-based rocker arm assembly could be changed through re-engineering the entire ICE, or by driving the valves via overhead camshafts. However, some applications of the high performance HEMI-ICE, such as stock car racing, must operate under rules that may dictate that the racing camshaft, valve location, valve angles must adhere to the original specifications of the car as when sold to an ordinary consumer. So any improvement thereof must only be done without changing regulated components such as the rocker arm assembly.

Other limitations of high performance ICE, including but not limited to HEMI-ICE, is that generally compressed between the bottom of the head cylinder 11 and the top of the engine block 12 is a head gasket (not shown). This head gasket generally prevents the high pressure combustion/compressed fuel air mixture of the combustion chamber from escaping and seeping into depressurized cylinders or the outside atmosphere leading to the degradation of engine performance. The head gaskets also prevent oil and coolant from passing from the head cylinder 11 and engine block 10 from leaking into cylinders and/or the outside atmosphere also leading to impaired ICE performance.

A set of studs, specially constructed and hardened metal rods with two ends that are essentially threaded to reversibly secure the rocker arm pedestals, cylinder head, head gasket and engine/cylinder block together. One end of the stud is generally threaded into a threaded aperture in the top of the engine block. The exposed threaded end of the stud generally passes through hole in the head gasket, a shaft cut into the cylinder head, to essentially pass out through the top of the cylinder head. At this point, the exposed threaded end could pass through a shaft cut through the rocker arm pedestal to come out at the top of the pedestal. A nut is threaded onto the exposed threaded end of the stud. In this manner, studs or other types of fasteners are used to tighten down and hold together the rocker arm pedestals, cylinder head, head gasket and engine block together. When due to such factors, such as very high compression pressure in a combustion chamber(s), the head gasket can rupture leading to the above described maladies.

Additionally, it is possible (due to the fact that the nut of the stud generally can only execute a pressure in a limited area on the cylinder head) that increasing size of the pressure area could help prevent the rupture of the head gasket rupture as well as prevent the possible warping of the cylinder head due to high pressure operating conditions of a particular ICE.

What is needed therefore is a rocker arm assembly for pushrod-based ICEs, including HEMI-type ICEs, that could be stronger, lighter than the present art; essentially handle the simple as well as complex valve angle geometry; generally help ameliorate the operation limitations imposed by high performance operations; and essentially increase the retaining pressure of the studs over greater portion of the cylinder head.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to accommodate complex valve geometry of an ICE;

the ability to resist warping of rocker arm assembly components, pushrods, valves caused by high performance operations;

the ability to resist warping of rocker arm assembly components, pushrods, valves caused by high performance ICE operations with valves having complex angle geometry;

the ability to quickly and easily remove a rocker arm assembly form an ICE the ability to remove and replace individual component of a rocker arm assembly with fully removing the valve train assembly;

provide a rocker arm assembly that is lighten and stronger than earlier rocker arm assemblies used with pushrod-based ICEs;

provide a rocker arm assembly and support stanchion that allows the rocker arm to swing fully through its available arc without interference or obstruction;

provide a unitary constructed support stanchion for a rocker arm assembly that is capable of being mounted using existing mounting systems;

the ability to improve and positively maintain a geometrically sound relationship between the pushrod, rocker arm and valve of each given cylinder;

provide multiple individual mounting points for each rocker arm;

provide exacting adjustment capability for the positioning of the individual rocker arm;

the ability to accept specially machined rocker arm for a respective valve without comprising other elements of the rocker arm assembly;

provide a stronger, more precise pivoting means for the rocker arms;

provide an external buttress against extremely high internal cylinder pressures associated with supercharging and nitrated fuels; and provide greater lateral support across the cylinder head to reduce the incidence of rupturing the head gasket(s) and warping of cylinder head(s) during high performance operations.

These and other advantages may be realized by reference to the remaining portions of the specification, claims, and abstract.

BRIEF DESCRIPTION OF ONE EMBODIMENT OF THE PRESENT INVENTION

One embodiment of the invention is generally a valve train assembly, comprising a unitary stanchion having a series of attachment points configured to reversibly secure the unitary stanchion to a cylinder head, the series of attachment points being located in a plurality of rows; and a plurality of rocker arms moveably attached to a unitary stanchion.

Another possible version of this embodiment is essentially an apparatus securing at least a portion of a cylinder head to a block of an internal combustion engine, comprising a unitary stanchion having at least two rows of fastener channels in parallel orientation; the fastener channels providing passage of a set of fasteners, with at least one fasteners having at least one end of the fastener secured into a block.

Another version of this embodiment is generally a valve train assembly comprising of a unitary base means for reversibly mounting a plurality of valve operation means; and a plurality of securing means for reversibly securing the unitary base to an internal combustion engine, wherein at least a portion securing means is essentially orientated into a plurality of rows.

Another version of this embodiment is possibly a methodology for providing an internal combustion engine with a valve train assembly, comprising, but not necessarily in the order shown below: passing at least two rows of fasteners, a portion of which can be secured to an the internal combustion engine, through a unitary stanchion that comprises a portion of the valve train assembly; placing at least a portion of the unitary stanchion in contact with a portion of the internal combustion engine; engaging fasteners in a manner to create a securing force that is generally applied to the unitary stanchion; and transmitting the securing force though the unitary stanchion to a portion of the internal combustion engine.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is generally to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
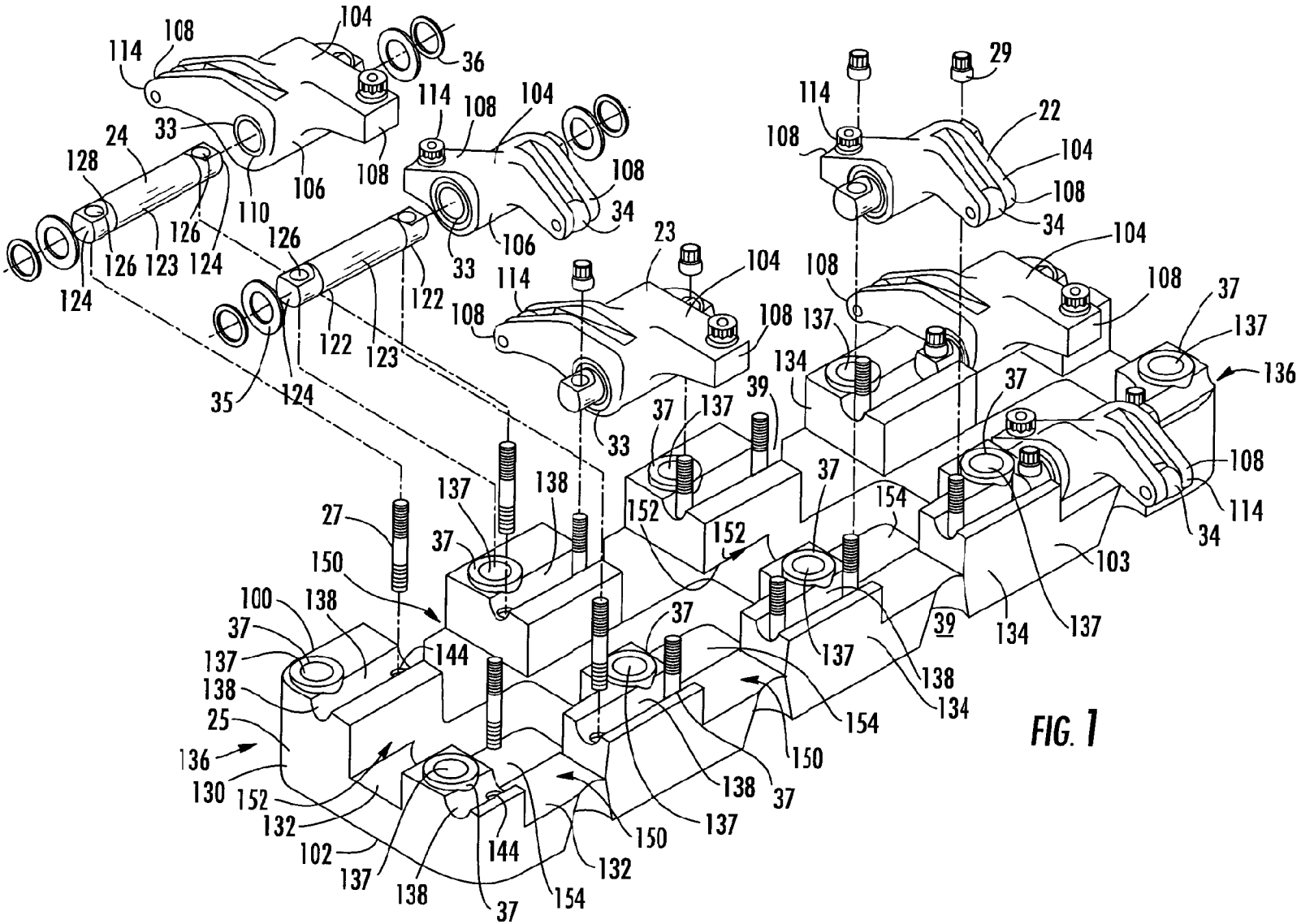
FIG. 1 is substantially a exploded perspective view of one embodiment of the present invention.

As generally shown in FIG. 1, the present invention comprises an apparatus and methodology for a rocker arm assembly or valve train assembly, is generally indicated by reference numeral 5. The rocker arm assembly 5 is generally located at the top of the ICE, generally being mounted upon a cylinder head 11 (shown in FIGS. 5 and 9). The rocker arm assembly or valve train assembly 5 is held to the cylinder head 11 (shown in FIGS. 5, 9) by way of fasteners 400 (as shown generally in FIG. 9). In at least one embodiment of the invention the fasteners may be comprised of block (e.g., engine block or cylinder block or both)-mounted head bolts or studs 30 (as shown generally in FIG. 9), which may be aligned with and located in original fastener locations for the cylinder head 11.

The rocker arm assembly 5 is generally comprised of showing a unitary stanchion 25 (e.g., a support plate), a plurality of pivotally mounted rocker arms 104, and plurality of fastener channels 137 that can accommodate at least a portion of a plurality of securing means for reversibly attaching the rocker arm assembly 5 to the ICE (e.g., the cylinder head 11).

The unitary stanchion 25, as its name implies, is made from a single piece of material. In at least one embodiment, it is milled from a solid bar or billet of 2024 aluminum. It is also seen that the unitary stanchion 25 could be made from other appropriate materials known in the art or would become known in the art (e.g., steel, magnesium, etc.) through other means of manufacture (casting, nanotechonology-based creation, etc.) known in the art or will become known in the art in the future.

The unitary stanchion 25 generally has a top 100 and bottom 102 which are essentially connected by sides 103. The top 100 generally supports removable plurality of pivotally-mounted rocker arms 104. The unitary stanchion 25 also generally provides for at least a plurality of rows of fastener channels 137, which correspondingly may reversibly receive a plurality of rows of fasteners 400 (as shown generally in FIG. 9). The invention may also provide for some or all of the rows of fasteners channels 137 (as shown generally in FIG. 1) to generally have a parallel orientation. In the present embodiment, the unitary stanchion 25 has two rows of fastener channels 137 in a generally parallel orientation. The structure of the unitary stanchion 25 will essentially be further described in greater detail below.

The rocker arm 104 as used in a rocker arm assembly can be essentially can be categorized as an intake rocker arm 22 or an exhaust rocker arm 23. The rocker arm 104 is generally attached to the rocker arm assembly 5 through a pivoting apparatus 123 such as a shaft 24 in combination with a needle roller bearing 33 (as essentially shown in FIGS. 6 and 8). The pivoting apparatus 123 provides the rocker arm 104 with the ability to pivoting or "see-saw" when moveably attached to the rocker arm assembly 5.

The present embodiment of invention essentially uses a shaft-mounted rocker arm which is moveably-mounted upon a shaft to obtain its pivoting or "see-saw" type movement. Other embodiments of the invention may use other versions of the rocker arms 104 such as stamped rocker am which in one version generally uses a ball shaped pivoting means.

In the present embodiment, the rocker arm (shaft mounted) 104 has a body 106 which essentially features two ends 108, and shaft channel 110. The shaft channel 110 is generally located laterally between the two ends 108 to traverses the sides 112 of the rocker arm 104 and is in general communication with a pivoting apparatus 123.

Figure 5:
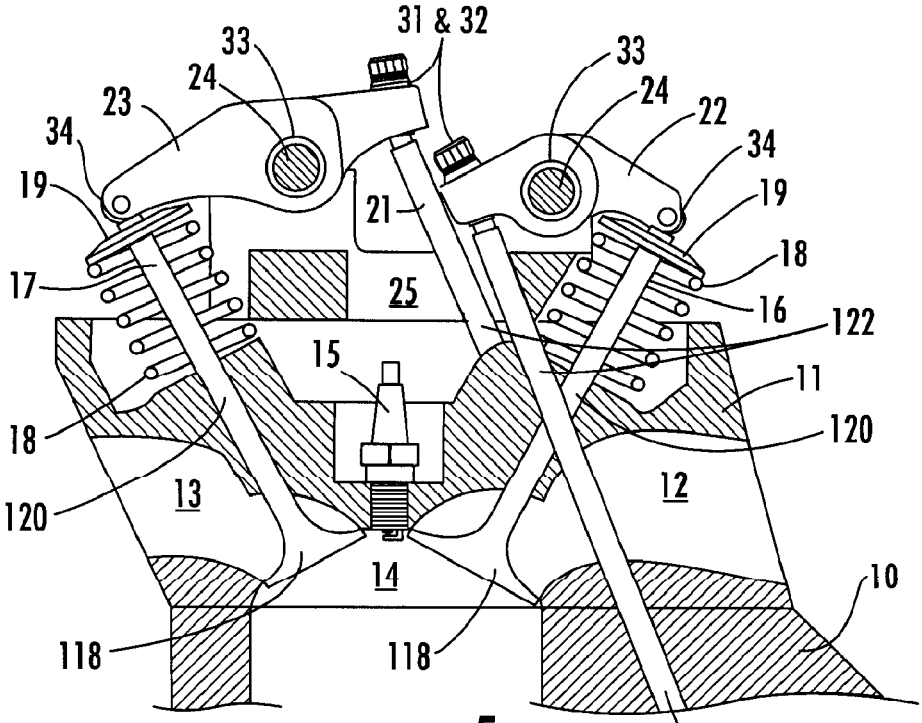
FIG. 5 is substantially a lateral cross section view of one embodiment of the invention.

The two ends 108 of the rocker arm 104 generally further comprise a valve end 114 and a camshaft end 116. The valve end 114 is essentially in communication with a stem 120 of a valve 118 (as shown generally in FIG. 5). In the preferred embodiment, a roller tip 34 may be moveably connected to the valve end 114 to essentially provide some moveable contact between the rocker arm 104 and the valve 118 (as generally shown in FIG. 5).

The camshaft end 116 is generally in indirect communication with a camshaft (not shown). In at least one embodiment, this indirect communication may be a pushrod 122 (associated with a lifter, not shown) may moveably connect the camshaft end 116 with the cam lobes (not shown) of the camshaft (not shown). In other embodiments, another means of communication (between rocker arm 104 and camshaft) besides a pushrod 122 (as shown essentially in FIG. 5) may be utilized.

The pivoting apparatus 123 of the rocker arm 104 generally provides the rocker arm 104 with its 'see-saw' movement capability. This pivoting apparatus 123 can be a wide variety of devices known or which will become known to the art in the future. In at least one embodiment of the invention, the pivoting apparatus 123 is essentially a rocker shaft 24 working in conjunction with a needle roller bearing 33 that is generally mounted in the body 106 of the rocker arm 104. In at least one embodiment of the rocker shaft 24, it may be a heated treated solid cylinder of metal that generally has two ends 124 with each end 124 featuring a stud aperture 126 and a C-clip ring 128. The stud aperture 126 accommodates at least a portion of the shaft hold down stud 29 for the securing of the rocker axle 24 and associated rocker arm(s) 104 between pedestals 134. In at least one embodiment, the axle 24 features more than two stud channels 126. The C-clip ring 128 reversibly accommodates a C-clip 36 which is used to generally secure spacing washers 35 onto the shaft 24 and next to the side 112 of the rocker arm 104 so as to properly locate and adjust the rocker arm 104 relative to its respective valve 118.

The shaft channel 110 essentially accommodates the needle roller bearing 33. In turn, the needle roller bearing essentially accommodates at least a portion of the shaft 24. The shaft 24 is of sufficient length so that when at least a portion of the shaft is generally placed within into the needle roller bearing located generally in the shaft channel 110, the ends 122 of the shaft 24 sufficient project from the sides 112 of the rocker arm 104 so that the rocker arm 104 does not block of the stud channels 126 or the C-clip rings 128.

The unitary stanchion 25 may be seen as having a base 130 with at least a top surface 132. In the present embodiment, a series of pedestals 134 may be seen a projecting form the top surface 132. In the present embodiment, which generally demonstrates the application of rocker arm assembly 5 which may be applied to HEMI-type ICE, these pedestals 134 may be used to generally position the respective rocker arms 104 so the rocker arms 104 may have sufficient geometry which allows the rocker arms 104 to generally interface with the pushrods 122 and valves 118 of pushrod-operated HEM type ICE. Other embodiments of the invention, whether or not being applied to a HEMI-type ICE may have or may lack pedestals 134 or may incorporate other structures as needed for the interfacing of the invention with a particular ICE.

The pedestals 134 in at least one embodiment can be generally located in multiple rows 136, generally indicated by numeral 136, which may further featuring a generally parallel orientation between some or all of the rows 136. The general spacing of the pedestals 134 in a row 136 may further define a primary space 150 between adjacent pedestals 134. Between each row 136 of pedestals 134 may be generally defined a centrally located secondary space 152. Located proximate to this secondary space 152 may be found a set of base apertures 154.

In at least one embodiment of the pushrod-based ICE applications of the invention, a portion of at least one push rod may pass through at least one base aperture 154. Similarly, for secondary space 152, in at least embodiment of the pushrod-based ICE applications of the invention, a portion of at least one push rod may pass through at least a portion of the secondary space 152.

Figure 9:
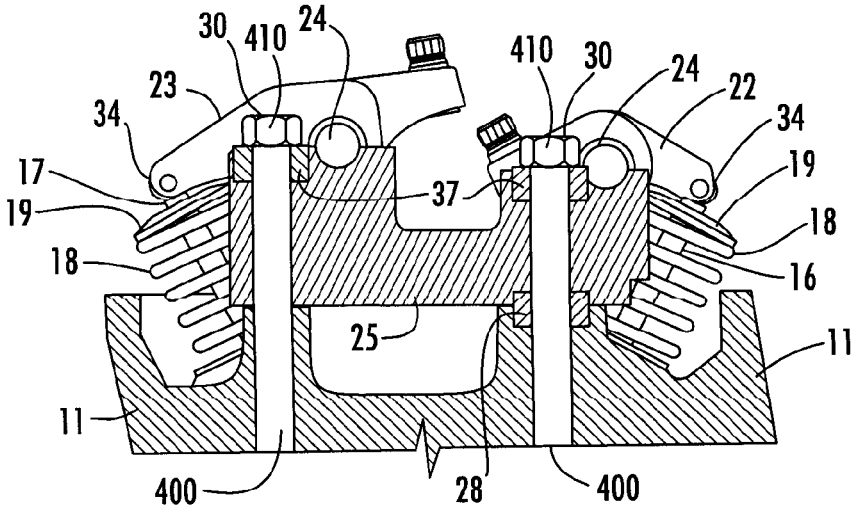
FIG. 9 is substantially a lateral cross-section view of one embodiment of the present invention as denoted as section D-D in FIG. 5.

In present embodiment, each pedestal 134 generally features a fastener channel 137 and an axle slot 138. In other embodiments of the invention, the fastener channels 137 may be located elsewhere on the base 130 of the unitary stanchion 25 in orientations and placement as may be required for the proper securing of unitary stanchion 25 (and the rocker arm assembly 5 in certain embodiments) to the ICE In the present embodiment, each fastener channel 137 generally traverses height of the unitary stanchion 25 to connect the top 140 of the pedestal 134 with the bottom 102 of the unitary stanchion 25. Each fastener channel 137 may further receive through a force fit a heat treated hollow metal cylinders, a bolt insert 37 and locating dowel 28 (generally shown in FIG. 9) The bolt insert 37 is generally received into at least a portion of a top portion of the fastener channel 137. Similarly, a dowel insert 28, is essentially partially received into at least a portion of a bottom portion of the fastener channel 137. Any exposed portion of the dowel inset 28 may be reversibly received into a top of a fastener channel 137 located in a cylinder head 11 to help with the positive alignment of the rocker arm assembly 5 to a cylinder head 11. Generally, through each fastener channel 137 (and corresponding bolt insert 37 and locating dowel 28, if applicable) passes a fastener 400 (e.g., stud, bolt, or the like) (as shown in FIG. 9). In at least one embodiment, the fastener 400 is block(e.g., engine block or cylinder block)-mounted at one end and is used to secure the invention to a top 200 of a cylinder head 11 as shown generally in FIGS. 5, 7, and 9.

The axle slot 138 is generally located on the top of a pedestal 134 in a generally horizontal orientation. Located within the axle slot 138 may be one or more shaft hold down stud apertures 144. The one end of a shaft hold down stud 27 may be secured into a corresponding shaft hold down stud aperture 144. Another portion of the shaft hold down stud 27 may pass through fastener channel 137 of a shaft 24 to reversibly engage shaft hold down nuts 29. In this manner, the shaft 24 may be affixed to two or more pedestals 134 to locate generally at least one rocker arm 104 between a pair of pedestals 134.

In the present embodiment, the axle slots 138 of a row of pedestals 134 generally share a common central axis as do any shafts 24 also located by the axle slots 138 of those pedestals 134 located in particular row 136. Similarly, any rocker arms 104 located in a row 136 of pedestals, in at least one embodiment could share a common central axis.

The unitary stanchion 25 also has provisions for valve spring clearance 39.

In the present embodiment of the invention, the fasteners 400, in combination with the fastener channels 137 (and as may be required, any dowel inserts 38 and any bolt insets 37) may engage the block portion(s) of the ICE and the unitary stanchion 25 to essentially act as one type of securing means. The securing means can be seen as providing a securing force which may be used essentially to reversibly secure the unitary stanchion 25 (and in certain embodiments, the rocker arm assembly 5) to the applicable ICE (e.g., cylinder head 11). It can also be seen that the securing means may be used to secure other parts of the ICE to one another, for example such as securing as well the cylinder head 11 (shown in FIGS. 5, 9) and head gasket (not shown to the block (cylinder block, engine block ) of the ICE. It should be noted that the securing means of the present embodiment, may in other embodiments be complimented or substituted for by other securing means known to the art or which may become known to the art in the future.

Figure 2:
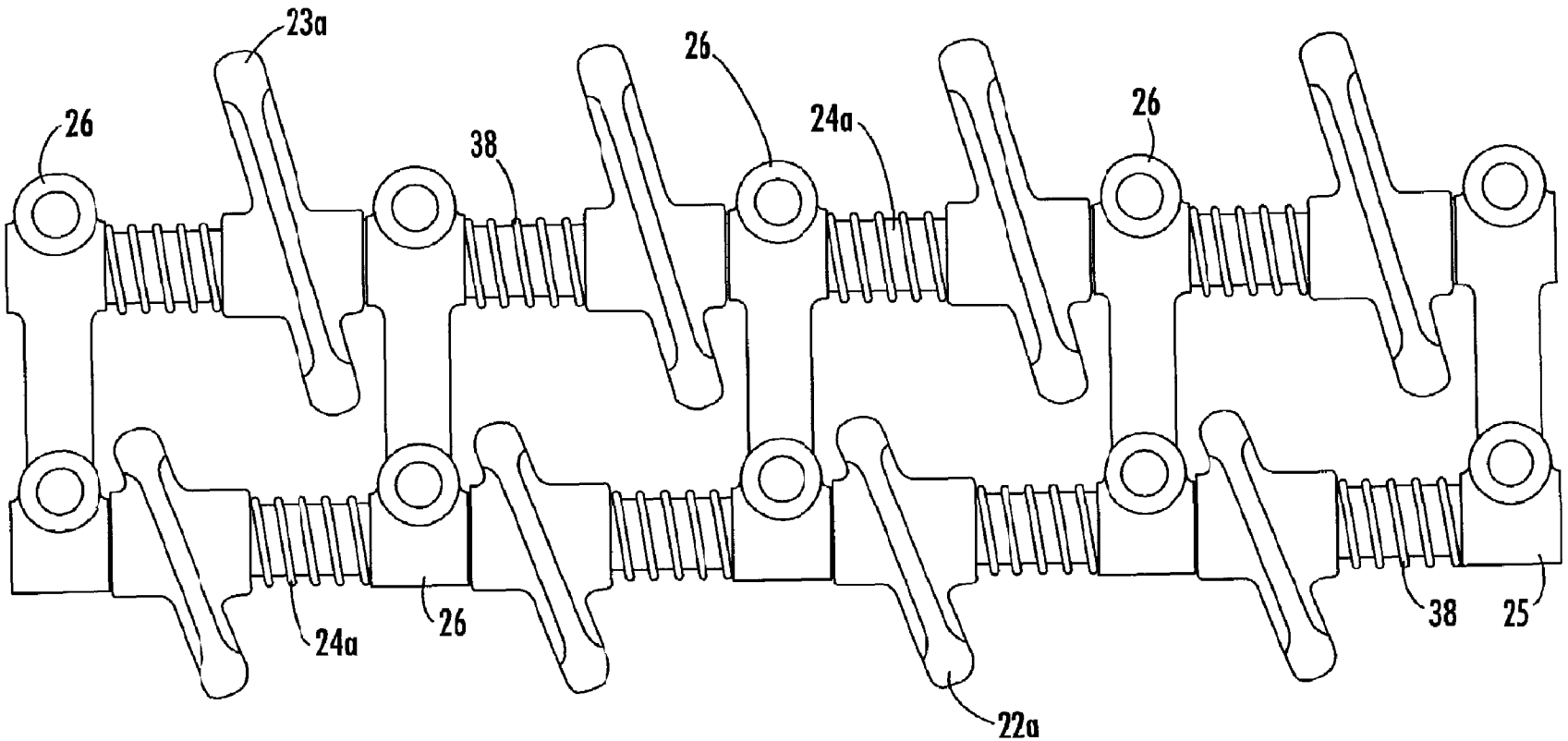
FIG. 2 (PRIOR ART)
FIG. 2 is substantially a top view of one embodiment of the prior art.

FIG. 2 generally shows an example of the prior art including an equipment shaft, individual pedestal 26 and rocker arm arrangement on a hemispherical combustion chamber, opposing-valve, pushrod design (e.g., a HEMI type) engine. The prior art intake 22*a* and exhaust 23*a* rocker arms may be non-adjustable, float on common hollow shafts 24*a* and are may be located laterally by springs 38. The prior hollow rocker shafts 24*a* may be spaced above the cylinder head (not shown) by individual pedestals 26. Each pedestal 26 may be connected by studs to the cylinder head. There generally is no other means of interconnecting support between the prior art pedestals other that the hollow shafts which are may be movable connected to the individual pedestals 26. In this manner, the lack of rigidity, mutual interlocking support between pedestals 26 may during operation of high performance ICE, allow operational forces, pressures, and the like, to essentially warp the shafts and corresponding move and warp the pedestals 26.

Figure 3:
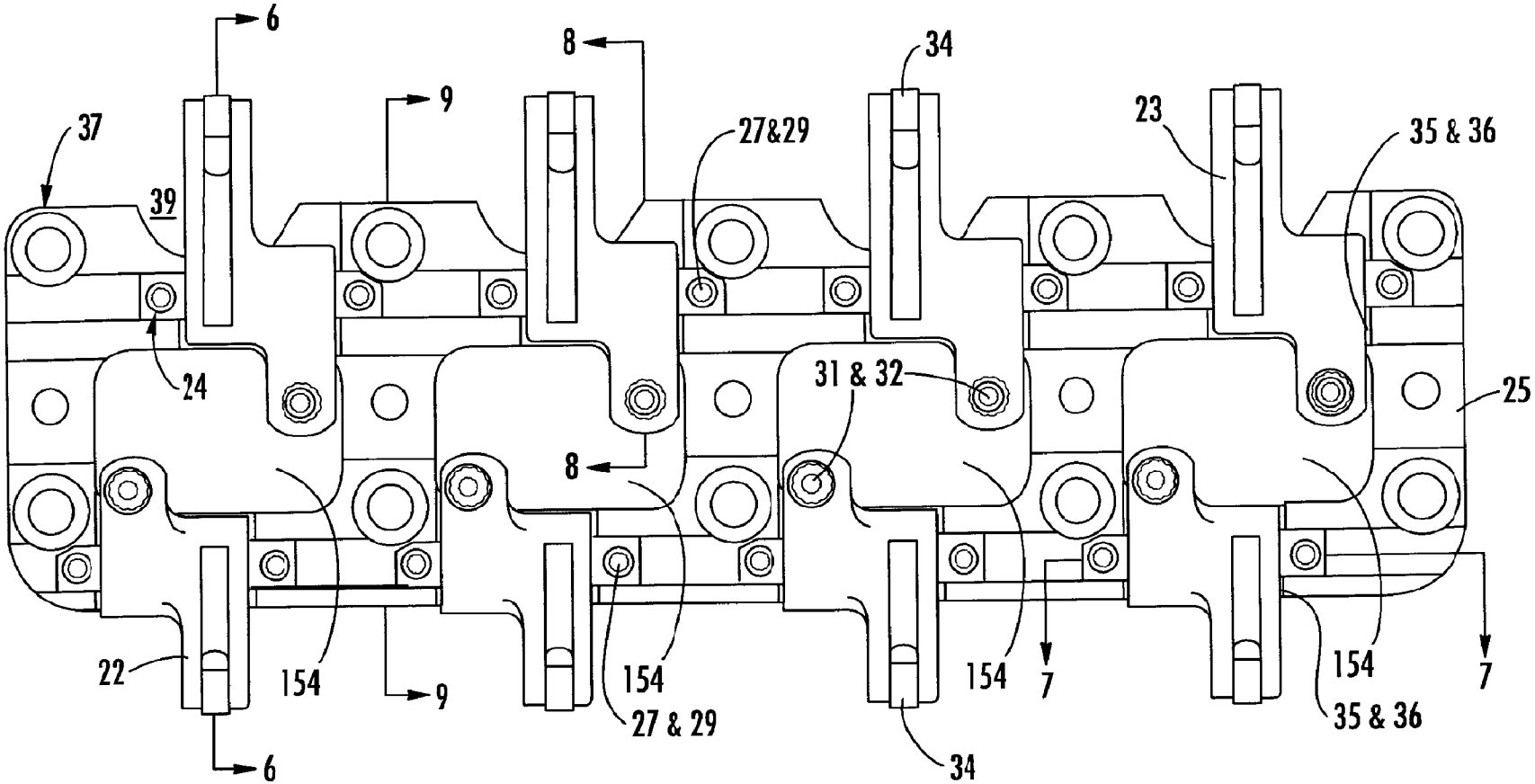
FIG. 3 is substantially a top view of one embodiment of the present invention.

FIG. 3 generally shows one embodiment of the invention with unitary stanchion 25 and its relationship to the individual rocker arm and shaft assemblies. As noted above, the unitary 25 stanchion may be held to the cylinder head (not shown) by way of the original fastener locations. Head bolts or studs (not shown) are essentially positively located in the stanchions by heat-treated head bolt inserts 37. Each intake rocker arm 22 and exhaust rocker arm 23 is generally mounted on solid heated treated rocker shafts 24. Valve-to-rocker clearance or lash adjustment provisions may be made by adjuster screws 31 immobilized by jam nuts 32. Frictional losses in the rocker arm-to-valve stem interface are essentially minimized by roller tips 34. Rocker and shaft assemblies may be locked in place to the unitary stanchion 25 by shaft hold down studs 27 and shaft hold down nuts 29.

Figure 4:
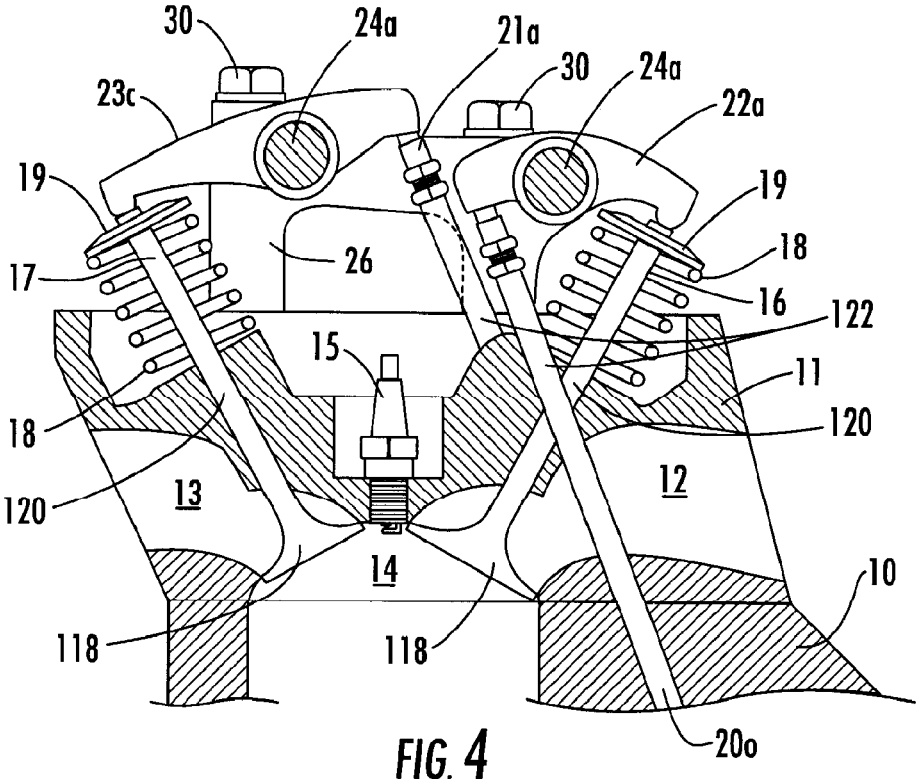
FIG. 4 (PRIOR ART)
FIG. 4 is substantially a lateral cross section view of one embodiment of the prior art.

FIG. 4 generally shows one version of the prior art as it may be arranged on a hemispherical combustion chamber, opposing-valve, pushrod design ICE. Cylinder head 11 may have at least one hemispherical (HEMI) combustion chamber 14 with a generally corresponding centrally located spark plug 15, intake 12 and exhaust 13 ports with their related intake 16 and exhaust 17 valves, valve springs 18 and spring retainers 19. The cylinder head 11 is essentially fastened to the cylinder block 10 with block-mounted studs or head bolts 30, which also locate individual prior art pedestals 26 to position a pair of hollow rocker shafts 24*a*. In between the cylinder head 11 and cylinder block 10 is generally located and compressed a head gasket (not shown). Intake 22*a* and exhaust 23*a* rocker arms essentially ride on the rocker shafts 24*a* on standard bearings and may given to motion by pushrods 20*a* that may or may not have adjusters 21*a* (used to adjust the valve lash) built into the pushrods 20*a* themselves.

FIG. 5 generally shows one embodiment of the invention as it may be arranged on a hemispherical combustion chamber (e.g. HEMI-type ICE), opposing-valve, pushrod design ICE. The cylinder head 11 may have at least one hemispherical combustion chamber 14, centrally located spark plug 15, intake 12 and exhaust 13 ports with their related intake 16 and exhaust 17 valves, valve springs 18 and spring retainers 19. The cylinder head 11 may be fastened to the cylinder block 10 with head bolts or studs 33 (shown in FIG. 9) through the original head bolt holes. In between the cylinder head 11 and cylinder block 10 is generally located and compresses a head gasket (not shown). These head bolts or studs also locate the stanchion 25. The intake 22 and exhaust 23 rocker arms ride on heat-treated rocker shafts 24 on needle roller bearings 33 and are generally given to motion by pushrods 20. Valve-to-rocker clearance or lash adjustment provisions are essentially made by rocker arm-based adjuster screws 31 generally immobilized by jam nuts 32.

Figure 6:
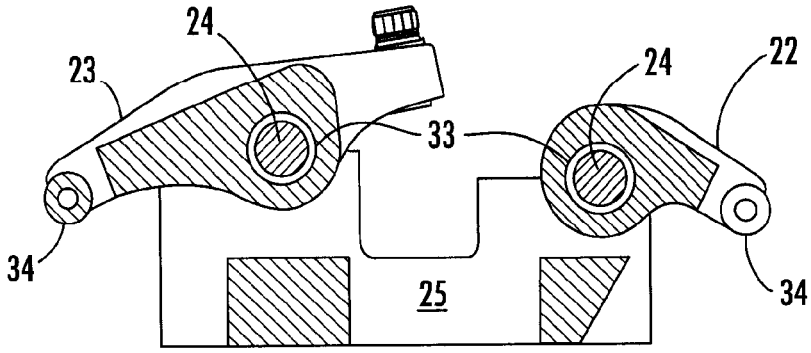
FIG. 6 is substantially a lateral cross-section view of one embodiment of the present invention denoted as section A-A in FIG. 5.

FIG. 6 generally shows a detailed cross-sectional end view of one embodiment of the invention showing essentially the stanchion 25, intake 22 and exhaust 23 rocker arms, rocker shafts 24, needle roller bearings 33 and roller rocker tips 34.

Figure 7:
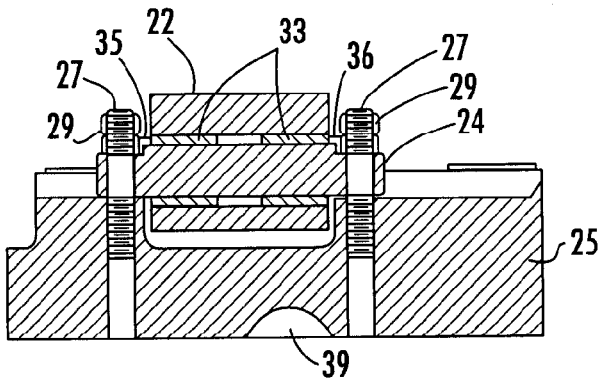
FIG. 7 is substantially a lateral cross-section view of one embodiment of the present invention denoted as section B-B in FIG. 5.

FIG. 7 generally shows a cross-sectional side of one embodiment of the invention showing the stanchion 25 and a typical rocker and shaft assembly. The rocker am 104, 22 essentially rides on a needle roller bearing 33 and heat-treated shaft 24 could be adjusted laterally with 0.030"-thick shim washers 35 and generally retained with snap rings 36. Each assembly may be fastened to the unitary stanchion 25 with shaft hold down studs 27 and nuts 29. This set up of the intake rocker arm assembly is essentially the same for an exhaust rocker arm assembly.

Figure 8:
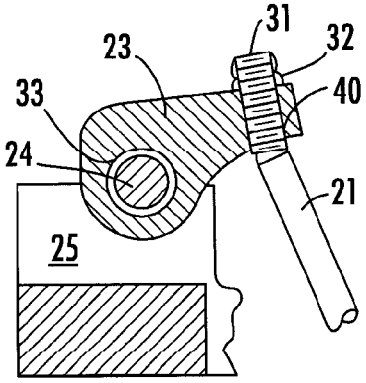
FIG. 8 is substantially a lateral cross-section view of one embodiment of the present invention denoted as section C-C in FIG. 5.

FIG. 8 generally shows a cross-sectional end view of one embodiment of the invention showing the adjuster or tail of a typical rocker arm 104 and shaft 24. As stated above, the rocker arm 104 essentially rides on a needle roller bearing 33 located on heat-treated shaft 24 essentially affixed to the unitary stanchion 25. Valve-to-rocker clearance or lash adjustment provisions are made by adjuster screws 31 immobilized by jam nuts 32. The pushrod-to-rocker arm interface is generally shown wherein the pushrod 21 rides in the pushrod cup 40 in the bottom end of the adjuster screw 32. Each rocker arm and shaft assembly 10 may be fastened to the unitary stanchion 25.

FIG. 9 essentially shows one embodiment of the invention with the unitary stanchion 25, intake 22 and exhaust 23 rocker arms, intake 16 and exhaust 17 valves, valve springs 18 and spring retainers 19, rocker shafts 24, needle roller bearings 33 and roller rocker tips and axles 34. Block-mounted head bolts or studs 30 fasten the unitary stanchion 25 and cylinder head 11 to the cylinder block 10 as generally shown in FIG. 5. Positive location of the unitary stanchion 25 to the cylinder head 11 may be provided by heat-treated hollow locator dowels 28 and heat-treated head bolt inserts 37.

The use of multiple rows of block-mounted fasteners 400 combined with a unitary stanchion 25, whose footprint that is spread over a greater lateral surface area of a top of cylinder head 11 (in general comparison with the prior art), correspondingly allows the invention to essentially spread out and distribute the securing force of securing means through the bottom 102 of the unitary stanchion 25 over a greater amount of the surface area of the top of cylinder head 11 (in general comparison with the prior art). In this manner, the unitary stanchion 25 can be seen to act as external buttress that could essentially more efficiently secures and compresses the cylinder head 11, the cylinder head gasket onto the block (e.g., cylinder block 10, engine block) of the ICE. This action can be seen as a potential way of preventing the warping of the cylinder head 11, preventing the rupturing of the head gasket during operations (e.g., high performance), of the ICE. In do so, may allow an ICE having the invention or aspects of the invention to obtain greater levels of high performance for longer periods of time.

One possible embodiment for the operation of the invention could comprise of the following steps. First, passing at least two rows of fasteners 400, a portion of which can be secured to the internal combustion engine, through a unitary stanchion 25. Second, placing the unitary stanchion 25 so its bottom 102 comes into contact with top of the cylinder head 11. Third, engage the fasteners 400 in a manner to create a securing force that is applied to the unitary stanchion 25. In one embodiment, this could be accomplished by tightening down the nuts 410 on the studs 30 until the nuts 410 come into contact with inserts 37. In other embodiments, bolts could be threaded into the block 10/cylinder head 11 and tightened down upon the unitary body 25. Fourth, as the securing force imparted to the unitary body, the transmitting/imparting of the securing force by the unitary body to the cylinder head 11 and block 10 (e.g., cylinder block, engine block and or both). Fifth, securing the cylinder head 11 is secured to the block using the securing force.

It should be pointed out to the reader that unlike other prior art which does use a unitary stanchion or body, the present invention provides for the attachment of the unitary stanchion 25 to the internal combustion engine while the rockers arms 104 are in place on the unitary stanchion 25. This action is essentially accomplished by not blocking the faster channels 137 with either the rocker arms 104 or the shafts 24. The construction of at least one embodiment of the invention could also provide for the step of attaching an individual rocker arm 104 to the unitary stanchion 25 as well as the step of adjusting an individual rocker arm 104 relative to its corresponding valve 118 (or pushrod 122).

The unitary stanchion design of the invention also essentially allows the operator to remove the entire rocker arm assembly 5 without having to remove any of the rocker arms 104 first. This action can be generally be accomplished by disengaging the fasteners 400 (e.g., unscrewing the bolts-not shown, or unscrewing the nuts 410) to terminating the securing force holding the rocker arm assembly 5 to the ICE. The fasteners 400 are then essentially withdrawn from the unitary stanchion 25 or the unitary stanchion 25 is generally withdrawn from the fasteners 400 (or both). The unitary stanchion 25 then is generally removed from contact with the ICE.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A rocker arm assembly, comprising:
   A) a unitary stanchion having a series of attachment points configured to reversibly secure the unitary stanchion to a cylinder head, wherein the unitary stanchion comprises a single piece of material;
   B) at least three rocker shafts fixedly mounted to the unitary stanchion; and
   C) at least three rocker arms, each one of the rocker arms being pivotably mounted to one of the rocker shafts, and wherein each rocker arm can be individually removed while the unitary stanchion is attached to the cylinder head.

2. The rocker arm assembly of claim 1 comprising eight rocker arms and eight rocker shafts.

3. The rocker arm assembly of claim 1 wherein the unitary stanchion is further comprised of a plurality of pedestals.

4. The rocker arm assembly of claim 3 wherein each pedestal has a pair of studs extending therefrom.

5. The rocker arm assembly of claim 4 wherein the rocker shafts have an aperture at each end.

6. The rocker arm assembly of claim 5 wherein the rocker shafts are mounted to the pedestals such that the studs extend through the apertures and a pair of fasteners are secured to the studs.

7. The rocker arm assembly of claim 3 wherein a space is located between each pedestal.

8. The rocker arm assembly of claim 7 wherein the rocker arm is mounted in the space.

9. The rocker arm assembly of claim 3 wherein an axle slot is located in the each pedestal.

10. The rocker arm assembly of claim 9 wherein the rocker shaft is mounted in the axle slot.

11. The rocker arm assembly of claim 1 wherein the unitary stanchion is further comprised of a set of apertures, each aperture accommodates the passage of one or more pushrods.

12. The rocker arm assembly of claim 1 wherein a bearing is mounted between the rocker shaft and the rocker arm.

13. The rocker arm assembly of claim 1 wherein the rocker arm is guided on the rocker shaft by a pair of c-clips mounted to the rocker shaft on each side of the rocker arm.

14. The rocker arm assembly of claim 1 wherein the unitary stanchion is mounted to a cylinder block by fasteners passing through the cylinder head.

15. The rocker arm assembly of claim 1 wherein the cylinder head has a hemispherical type combustion chamber.

16. A rocker arm assembly, comprising:
   A) stanchion means for providing a unitary rigid support, the stanchion means comprising a single piece of material and adapted to be mounted to a cylinder head;
   B) rocker shaft means for providing a rotating support, the rocker shaft means fixedly mounted to the stanchion means, the rocker shaft means comprising at least three rocker shafts; and
   C) rocker arm means pivotably connected to the rocker shaft means for providing a pivoting connection between a pushrod and a valve, and wherein an individual rocker arm can be individually removed while the stanchion means is attached to the cylinder head; and
   D) fastener means for securing the rocker shaft means to the stanchion means.

17. The rocker arm assembly of claim 16 wherein the rocker arm means comprises eight rocker arms and the rocker shaft means comprises eight rocker shafts.

18. The rocker arm assembly of claim 16 wherein the stanchion means further comprises:

a) a plurality of pedestals; and b) a pair of studs extending from each pedestal.

19. The rocker arm assembly of claim 18 wherein the rocker shaft has an aperture at each end, the rocker shaft being mounted to the pedestal such that the studs extend through the apertures, the fasteners means being secured to the studs.

20. The rocker arm assembly of claim 18 wherein an axle slot is located in each pedestal.

21. The rocker arm assembly of claim 20 wherein the rocker shaft means are mounted in the axle slot.

22. The rocker arm assembly of claim 16 wherein the stanchion means further comprises a set of apertures, each aperture accommodates the passage of one or more of the pushrods.

23. The rocker arm assembly of claim 16 wherein bearing means are mounted between the rocker shaft means and the rocker arm means.

24. The rocker arm assembly of claim 16 wherein the rocker arm means are centered on the rocker shaft means by a pair of c-clips mounted to the rocker shaft means.

25. The rocker arm assembly of claim 16 wherein the stanchion means is mounted to a cylinder block by fasteners passing through the cylinder head into the cylinder block.

26. The rocker arm assembly of claim 16 wherein the cylinder head has a hemispherical type combustion chamber.

27. A rocker arm assembly comprising:

A) a unitary stanchion having a series of attachment points configured to reversibly secure the unitary stanchion to a cylinder head, wherein the unitary stanchion comprises a single piece of material and is mounted to the cylinder head by fasteners passing through fastener channels in the cylinder head;

B) at least three rocker shafts fixedly mounted to the unitary stanchion;

C) at least three rocker arms, each one of the rocker arms being pivotably mounted to one of the rocker shafts; and D) wherein the rocker arms and the rocker shafts are configured to not block the fastener channels to provide for individual attachment and removal of each rocker arm while the unitary stanchion is attached to the cylinder head.

* * * * *